US005735772A

United States Patent [19]

Schiavoni

[11] Patent Number: 5,735,772

[45] Date of Patent: Apr. 7, 1998

[54] METHOD AND DEVICE FOR IMPROVING ORAL MOTOR FUNCTION

[76] Inventor: Mary E. Schiavoni, 136 Arlington St., Brighton, Mass. 02135

[21] Appl. No.: 599,730

[22] Filed: Feb. 12, 1996

[51] Int. Cl.[6] ..... A63B 23/03; A61J 17/00; A61C 19/04

[52] U.S. Cl. ..... 482/11; 606/235; 606/234; 433/69

[58] Field of Search ..... 482/11; 606/235, 606/234; 128/777; 433/69

[56] References Cited

U.S. PATENT DOCUMENTS

| | | | |
|---|---|---|---|
| 2,115,405 | 10/1938 | Allen . | |
| 3,118,667 | 1/1964 | Barons . | |
| 3,867,770 | 2/1975 | Davis . | |
| 3,924,850 | 12/1975 | Robertson . | |
| 4,997,182 | 3/1991 | Kussick . | |
| 5,213,553 | 5/1993 | Light . | |
| 5,263,976 | 11/1993 | Williams | 606/235 |
| 5,334,218 | 8/1994 | Johnson | 606/235 |

FOREIGN PATENT DOCUMENTS

| | | |
|---|---|---|
| 822 | of 1892 | United Kingdom . |
| 12655 | of 1896 | United Kingdom . |
| 2159720 | 12/1985 | United Kingdom . |

OTHER PUBLICATIONS

Morris and Klein, "Pre-Feeding Skills," 1987, pp. 261–269, published by Therapy Skill Builders of Tucson, Arizona.

*Primary Examiner*—Richard J. Apley
*Assistant Examiner*—William LaMarca
*Attorney, Agent, or Firm*—O'Connell Law Firm

[57] ABSTRACT

A method and device for developing the ability to demonstrate graded jaw closure and repetitive, rhythmical mandibular movement over an improved range of motion in those suffering from limiting oral motor dysfunction. The method begins with providing an embodiment of the inventive device. Essentially, the inventive device may be comprised of a non-nutritive, non-toxic and elongated biting portion comprised of a yieldable and resilient tube which has a given effective lateral thickness and is adapted to be received between an upper and a lower biting surface of an orally dysfunctional person's mouth and a handle position securely connected to the biting position for enabling manipulation of the device from a position external to a user's mouth. Next, the orally dysfunctional person is instructed and, if necessary, assisted in holding the biting position of the device between the person's biting surfaces for progressively greater length's of time. After that, the orally dysfunctional person is instructed and, if necessary assisted in engaging in a progressively increasing number of cycles of repetitive, rhythmical excursion and closure of the person's biting surfaces on the biting position of the device.

5 Claims, 5 Drawing Sheets

METHOD AND DEVICE FOR IMPROVING ORAL MOTOR FUNCTION

FIELD OF THE INVENTION

The present invention relates to a method and device for improving oral motor function.

BACKGROUND

Normally, the development of the ability to eat occurs with a sure and steady smoothness that renders it generally unremarkable. As a child's body and mind mature, there first develops a proximal stability of the trunk and head which soon allows for improved control of distal joints and muscles such as those involved in mastication. Formerly gross and unrefined jaw, cheek, tongue and lip movements follow a developmental continuum that eventually leads to a fine independence, dexterity, and coordination of movement between them. Acquiring such fine motor function is a prerequisite to normal feeding skill development.

In temporal sequence, feeding skills begin with the primal ability to suckle which normally is present at birth. The rhythmical forward and backward tongue motion of suckling is a baby's first method of nutritive ingestion. Eventually, the child learns to suck with a raising and lowering of the tongue and a small excursion of the jaw to create a negative sucking pressure. The sucking skill soon is supplemented by an up-and-down phasic bite-and-release motion of the jaw. At this point, the jaw moves in a primitive, stereotypic rhythm, and the tongue has yet to achieve independent movement and control. As chewing skills improve, however, the jaw begins to move with greater control in a non-stereotypic movement, and the tongue develops some independence to move laterally and to direct the food bolus. Later, control over the jaw increases to a point at which the child can exhibit controlled and sustained biting, and the jaw can carry out the more mature and efficient diagonal rotary movement typical of adult mastication. At this point, the tongue can transfer food laterally with minimal difficulty. Finally, by the end of his or her third year, the typical child masticates with a mixture of nonstereotypic, diagonal rotary, and circular rotary jaw movements. The child's cheeks and tongue can quickly and skillfully effect food transfer. At that time, feeding skills are optimized, and the prerequisite to a normal digestive process, mastication, is carried out effortlessly. Proper mastication tears, crushes, and grinds food to a more easily digested form. Swallowing then propels the bolus of chewed food from the mouth, through the pharynx, through the esophagus, and finally into the stomach where true digestion begins.

Unfortunately, the ideal oral motor function described above can be compromised in any one of several ways. Oral motor dysfunction can manifest itself developmentally in such ways as jaw thrust, tonic bite reflex, jaw clenching, and jaw retraction, all of which may be patterns associated with cerebral palsy. Dysfunction can also arise as a result of acquired neurological abnormalities due to stroke and head trauma. Structural abnormalities due to injuries, disease, and congenital sources also can affect oral motor function. Each of these sources of oral motor dysfunction can effect partial or complete inability to demonstrate graded jaw closure and repetitive mandibular movement, the cornerstones of effective mastication.

Regardless of the source, oral motor dysfunction can have profound effects on the lives of those confronted therewith and those charged with their care. Since proper chewing is a prerequisite to a normal and safe digestive process, oral motor dysfunction can impose serious limitations on nutritive ingestion ranging from dietary change to medical intervention. For example, oral motor dysfunction may require the introduction of pureed foods or the installation of naso-gastric or gastrostomy tubes. Absent some modification in diet or means of ingestion, oral motor dysfunctions which inhibit graded jaw closure and repetitive mandibular movement over an acceptable range of motion can present serious dangers such as choking and malnutrition.

Although there have been attempts at controlling tongue thrust such as the "Tongue Thrust Correction Device" found in U.S. Pat. No. 4,997,182; devices designed to improve tongue strength and placement such as "Devices Used to Improve Speech, Swallowing and Mastication" found in U.S. Pat. No. 5,213,553; and weight devices for exercising the face, neck and lip muscles as exemplified by the "Mouth Exerciser for Strengthening Face, Neck and Lip Muscles" shown in U.S. Pat. No. 3,118,667; no invention has been disclosed that effectively develops the core need for graded jaw closure and repetitive mandibular movement.

With the above in mind, it becomes clear that there is a very great need for an invention which improves oral motor function through the development of graded jaw closure and repetitive mandibular movement to enable the orally dysfunctional to eat through their mouths safely and effectively.

SUMMARY OF THE INVENTION

Advantageously, the present invention's principle object is the providing of a method and device that develop the ability to demonstrate graded jaw closure and repetitive, rhythmical mandibular movement over an improved range of motion in those suffering from limiting oral motor dysfunction. A further object of the inventive method and device is the improvement in jaw, tongue, lip and cheek dexterity and independence for enabling improved abilities of mastication, speech and swallowing. It is the ultimate object of the invention to enable orally dysfunctional persons to employ the abilities developed by use of the present method and device to be able to chew and swallow course, ground, and even regular foods safely and effectively. These and other objects of the invention will become obvious as one reads this specification.

The present invention accomplishes the aforementioned objects through a multi-step, progressive process which employs at least one non-nutritive and non-toxic chewing device with a portion thereof comprising a biting portion with a given effective lateral thickness and adapted to be received between the biting surfaces of a person's mouth. In its most essential form, the process begins with locating a chewing device of a selected effective lateral thickness between the biting surfaces of the subject's mouth. Ideally, the biting portion of the device is located at a lateral position in the mouth such as between the crushing molar teeth if they are in place. Next follows instructing and, if necessary, assisting the subject in holding the chewing device by its biting portion between the subject's biting surfaces with a sustained bite for a desired length of time. Once that ability is established, the process continues by instructing and, if necessary, assisting the subject in performing a cycle of excursion and closure of the jaw about the biting portion of the chewing device. Next follows instructing and, if necessary, assisting the subject to perform additional, repetitive cycles of excursion and closure of the jaw about the biting portion of the device.

Although the above described steps comprise the essential performance of the inventive process, the process most optimally is practiced with the repetition of the aforementioned steps with additional devices having biting portions of differing effective lateral thicknesses. For example, the steps may be performed first with a chewing device of a relatively thick lateral thickness to be succeeded by sequentially thinner chewing devices. Alternatively, the devices may be selected to begin with a relatively thin lateral thickness to be followed by progressively thicker devices. As will be explained in more detail below, the selection of the progression of biting portion thicknesses depends on the dysfunction sought to be addressed.

As the means by which the progressive development of mastication is carried out, the chewing devices essentially are comprised of a non-nutritive, non-toxic, and elongated biting portion of a given effective lateral thickness which is adapted to be received between an upper and a lower biting surface of an orally dysfunctional person's mouth and a handle portion securely connected to the biting portion for enabling manipulation of the device from a position external to a user's mouth.

The chewing devices generally described above may assume many different forms. Although it is conceivable that the chewing device could be a solid bar of non-nutritive material, it has been found more preferable that at least the biting portion be in the form of a flexible, elongated tube with a substantially uniform lateral thickness therealong. To avoid possible dangers which such a tubular configuration might present, it is more preferable still that the handle portion of the device include a means for preventing the device from being choked on by the user. This prevention means may be comprised of a stopping flange included as part of the handle portion of the device. Alternatively or additionally, the prevention means may be comprised of a strip of flexible material attached to the handle portion of the device for tethering to an outside object. A still further variation of the device is contemplated wherein the handle portion is comprised of an elongated crossbar for preventing the device from completely entering the mouth of the user.

In light of the progressive nature of the inventive method, it may be advantageous to distribute the devices in the form of a kit comprised of a complemental series of the unitary devices with each device having a different effective lateral thickness at its biting portion. The complemental series may include just two differently sized devices, or it may include as many more than that as may suit the needs of the therapist and the subject. For example, the kit may include four devices with biting portions of respective lateral thicknesses of one-fourth, three-eighths, one-half, and three-quarters of one inch. Such a complemental series of devices would enable one to practice the inventive method in a most advantageous form. However, in this context one must note that it is conceivable that a single device may be crafted to serve the purpose of a multiplicity of complemental devices. For example, a unitary device may be created having a multiplicity of differently-sized, elongated biting portions extending from a central area of the device whereby the progressive process may be carried out by proceeding from biting portion to biting portion of the device.

The foregoing discussion broadly outlines the more important features of the invention to enable a better understanding of the detailed description that follows and to instill a better appreciation of the invention's contribution to the art. Before an embodiment of the invention is explained in detail, it must be made clear that the following details of construction, descriptions of geometry, and illustrations of inventive concepts are mere examples of possible manifestations of the invention.

DETAILED DESCRIPTION OF THE PREFERRED EMBODIMENTS

Figure 1A:
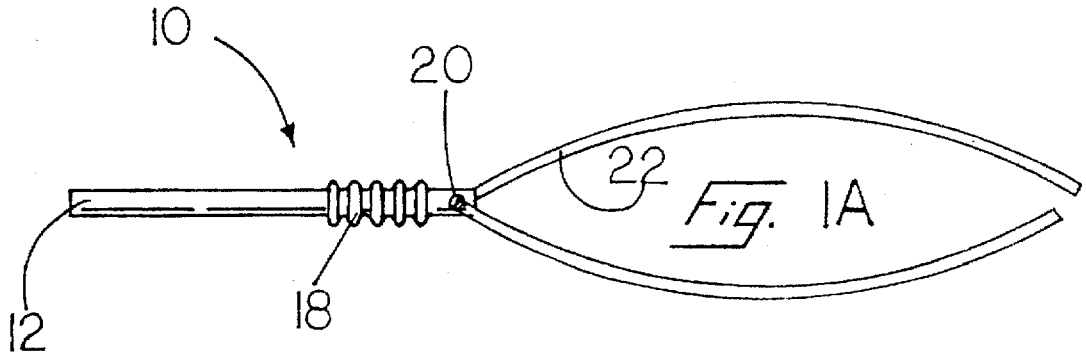
FIGS. 1A, 1B, 1C, and 1D are plan views of a complemental series of chewing devices according to one embodiment of the invention.
Figure 1B:
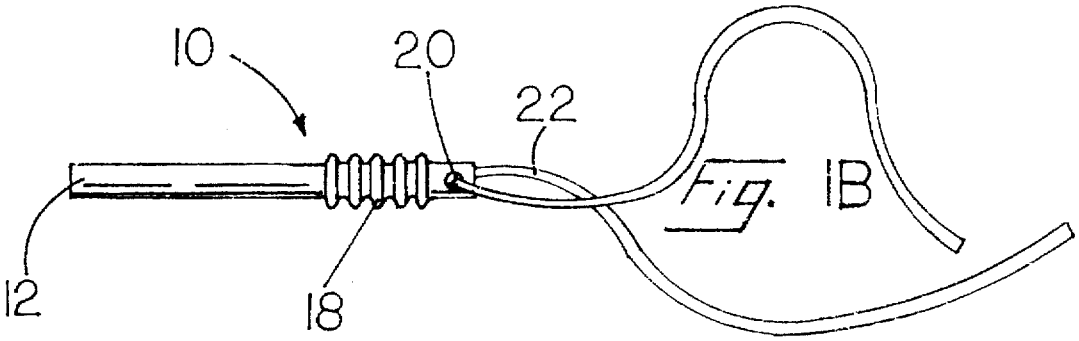
Figure 1C:
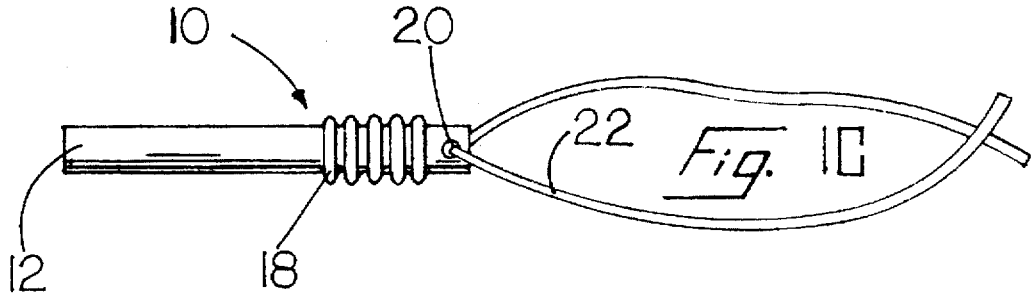
Figure 1D:
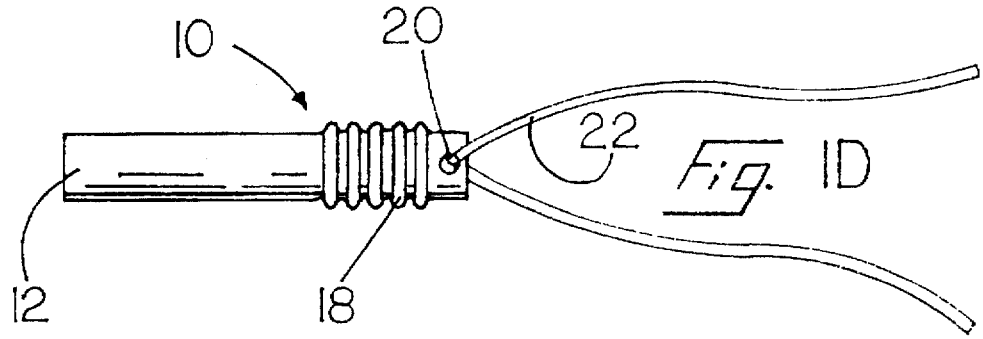
Figure 2A:
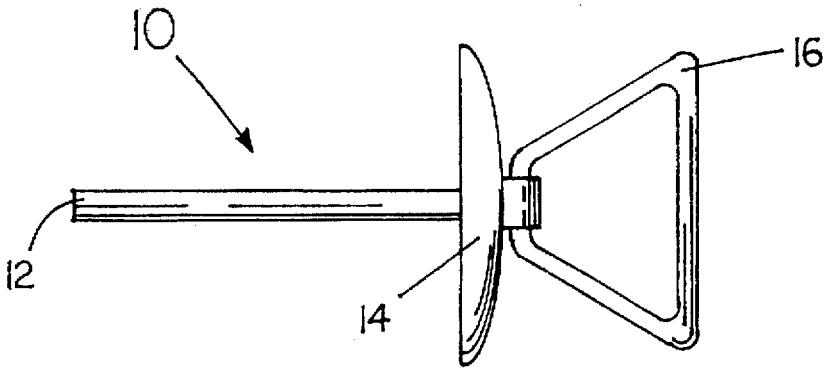
FIGS. 2A, 2B, 2C, and 2D are plan views of a complemental series of chewing devices according to another embodiment of the invention.
Figure 2B:
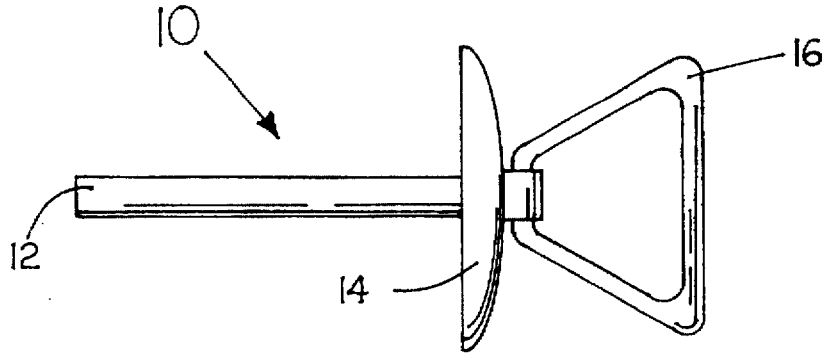
Figure 2C:
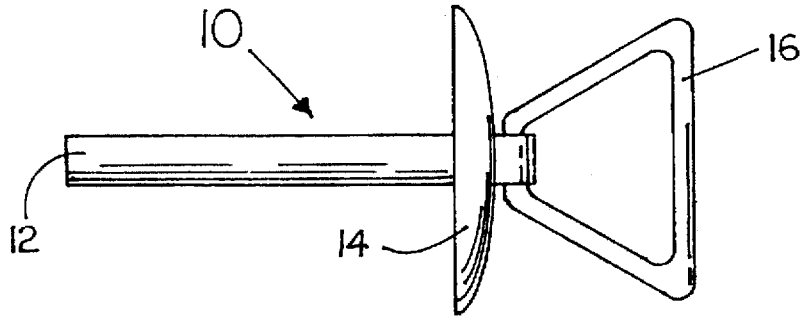
Figure 2D:
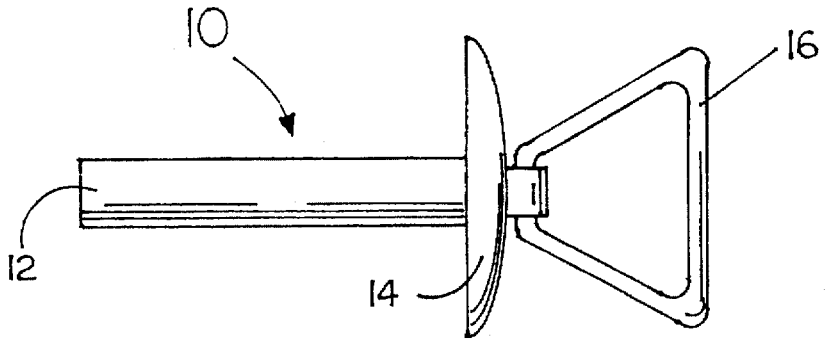

The broad nature of the present invention can lend itself to many different forms. However, to enable the proper practice of the invention and an understanding of the significance thereof, this portion of the specification shall set forth the processes and devices found most preferable for remedying many types of oral motor dysfunction.

The chewing devices shown in FIGS. 1A–1D, 2A–2D, 3A–3D, and 4 depict alternative preferred embodiments of the chewing devices. The devices are grouped in kit form with a first preferred embodiment depicted in FIGS. 1A–1D, a second preferred embodiment shown in FIGS. 2A–2D, a third preferred embodiment shown in FIGS. 3A–3D, and a fourth, unitary preferred embodiment shown in FIG. 4. In the first, second, and third series of devices 10, each of the devices 10 differs from the others in its respective group by the relative lateral thickness of an elongated tubular biting portion 12 comprising a first end of each device 10. In the fourth figure, a single device 30 performs the function of a four-device kit by use of a multiplicity of arms 32, 34, 36, and 38 which project radially from a central area 40.

Taking the chewing device 10 shown in FIG. 1A as a first example, the device 10 includes an elongated tubular biting portion 12 which is intended to be received between the biting surfaces of the mouth of an orally dysfunctional person. As the devices 10 are intended to be manipulated manually from a position external to the mouth, an annular handle portion 18 is securely connected to and extends from the biting portion 12. In the first preferred embodiment, the handle portion 18 is of substantially the same lateral thickness as the elongated tubular biting portion 12, and it has a corrugated surface to provide better control of the elongated tubular biting portion 12. As FIGS. 1A–1D show, the corrugated surface is comprised of a multiplicity of annular ridges and furrows spaced along the handle portion 18. In the FIG. 1 series of preferred embodiments, the devices 10 further include a hole 20 in the handle portion 18 through which passes a strip of flexible material 22. When tethered to an outside object, the flexible material 22 acts as a means for preventing the device 10 from passing so far into the mouth cavity as to be choked on or swallowed.

Referring more particularly to FIGS. 2A–2D which show another preferred embodiment of the invention, there is shown a complemental kit of four devices with each of which being indicated generally at 10 in its respective drawing. Considering FIG. 2A as representative of the FIG. 2 series of devices, each of the devices 10 once again includes an elongated tubular biting portion 12 In each device, the elongated tubular biting portion 12 is of a substantially consistent lateral thickness therealong. This second series of devices differs from the first mainly in the means of preventing the accidental choking on and/or swallowing of the device 10. In the FIG. 2 series of devices, a most reliable prevention means is shown as a stopping flange 14. The flange 14 is of a sufficiently great lateral dimension that it can not fit completely within the mouth of a user. With that, problems of choking or swallowing are alleviated. For most effective manual manipulation of the device 10, the handle portion further includes a ring handle 16.

Figure 3A:
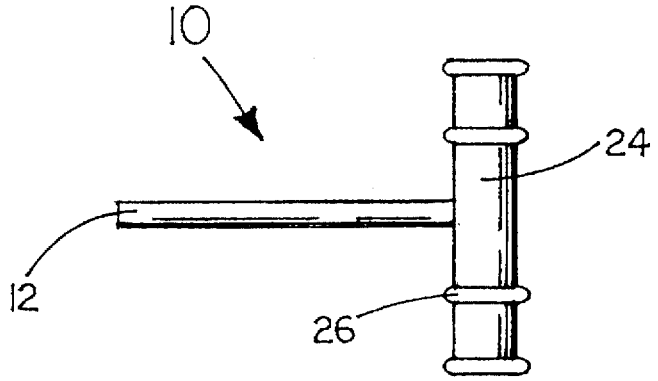
FIGS. 3A, 3B, 3C, and 3D are plan views of a complemental series of chewing devices according to still another embodiment of the invention.
Figure 3B:
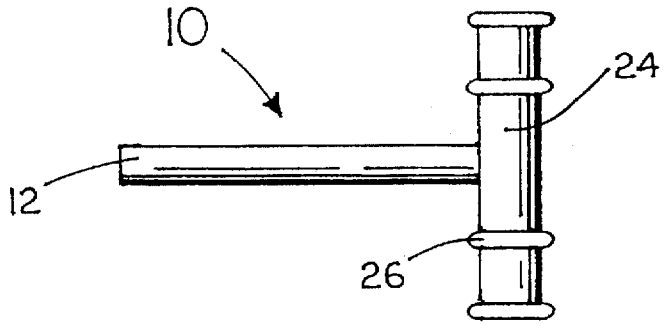
Figure 3C:
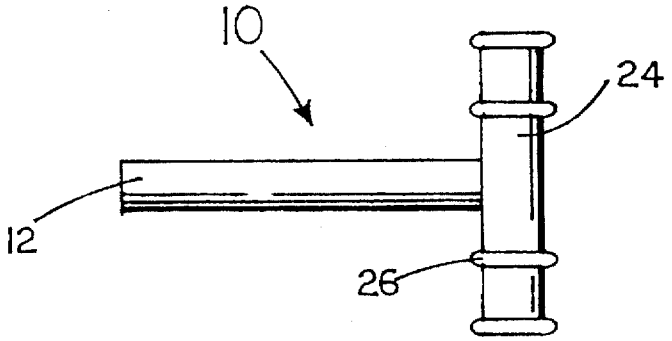
Figure 3D:
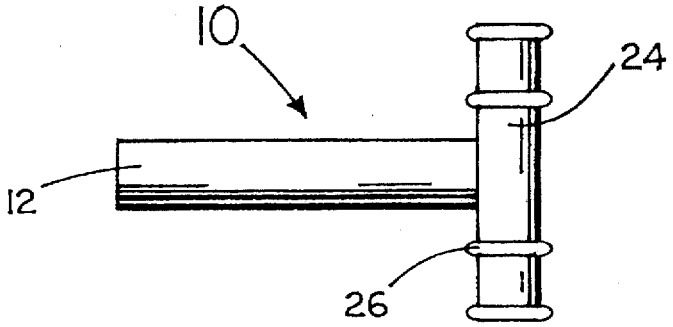

FIGS. 3A–3D illustrate a third series of complemental chewing devices with each device again being shown generally at 10 in its respective drawing. The device 10 of FIG. 3A is typical of this third group wherein each of the devices 10 includes an elongated tubular biting portion 12. Unlike the other series of devices, this group includes a crossbar 24 which is securely connected to the biting portion 12 and comprises the handle portion of the device. The crossbar 24 performs the dual function of enabling manual manipulation of the device 10 from a position external to the mouth and of preventing choking on or swallowing the device 10. For still better control of the device 10, this preferred embodiment further includes grip ridges 26 on the crossbar 24.

Figure 4:
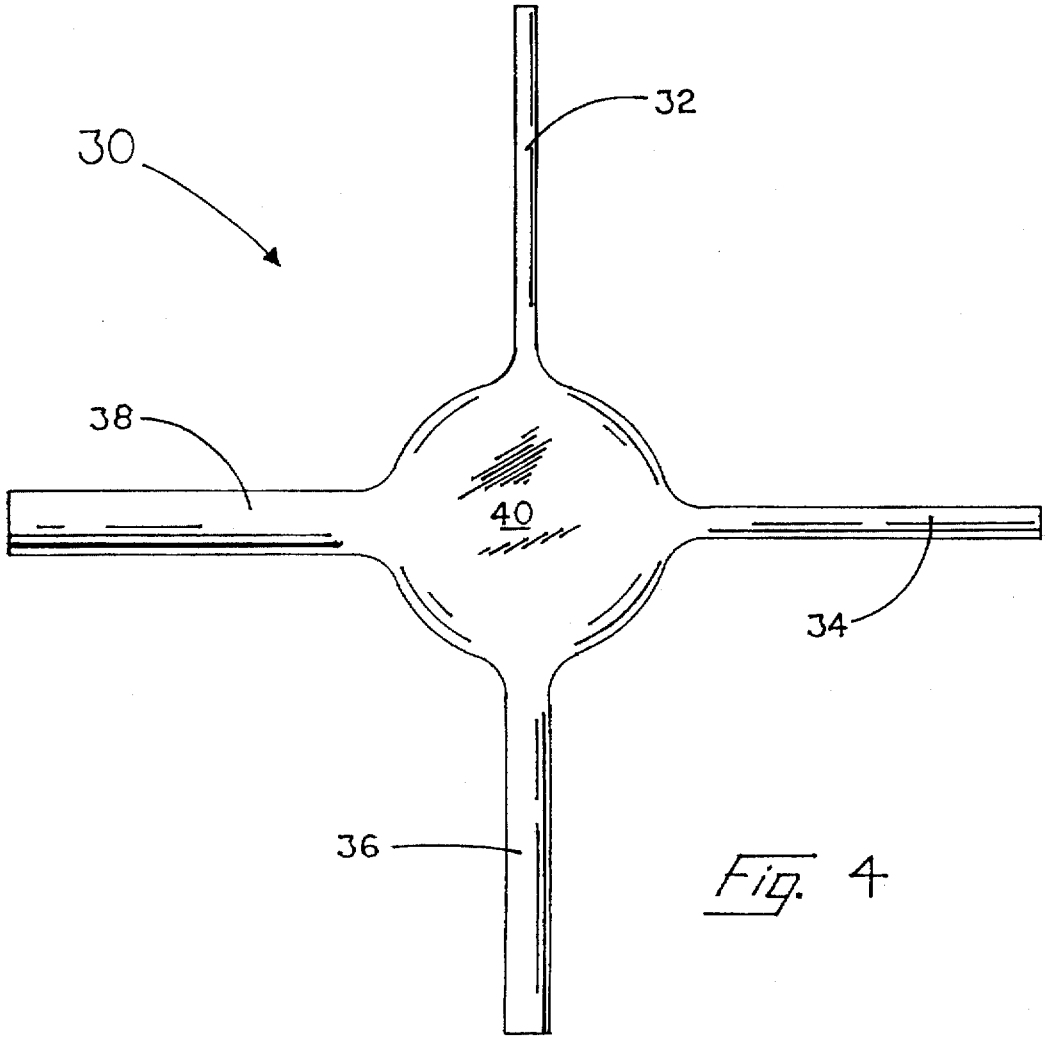
FIG. 4 is a plan view of an alternative, unitary chewing device.

FIG. 4 depicts a unitary chewing device 30 which has four legs 32, 34, 36, and 38 projecting radially from a central area 40. Each of legs 32, 34, 36, and 38 comprises an elongated, tubular biting portion. Each leg 32, 34, 36, and 38 has a different lateral thickness than the other legs. Consequently, the unitary device 30 is able to perform the function of the four device kits shown in FIGS. 1A–1D, 2A–2D, and 3A–3D. Furthermore, by having the four legs 32, 34, 36, and 38 projecting at substantially right angles to each other, both a handle and an anti-choking means are provided.

Having described four most preferred embodiments of the inventive device, a most preferred embodiment of the method of performing the method of the invention follows. The method begins with the providing of a non-nutritive and non-toxic chewing device with a portion thereof adapted to be received between the upper and lower biting surfaces of an orally dysfunctional person's mouth. Most preferably, this first step of providing a chewing device would comprise providing one of the preferred embodiments of the invention such as is shown in FIGS. 1A–1D, 2A–2D, 3A–3D, or 4; the following discussion will describe use of devices as illustrated in FIGS. 3A–3D. Still more preferably, the steps which will be set forth below may be performed with both the therapist and the orally dysfunctional person facing a mirror to increase visual feedback to both participants.

Figure 5A:
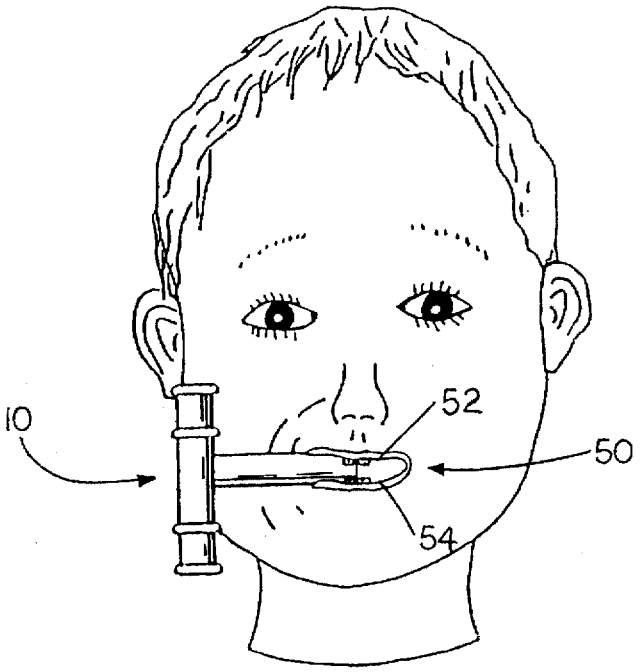
FIGS. 5A and 5B illustrate from the front and side respectively a most preferred method of using the chewing device shown in FIG. 3D.
Figure 5B:
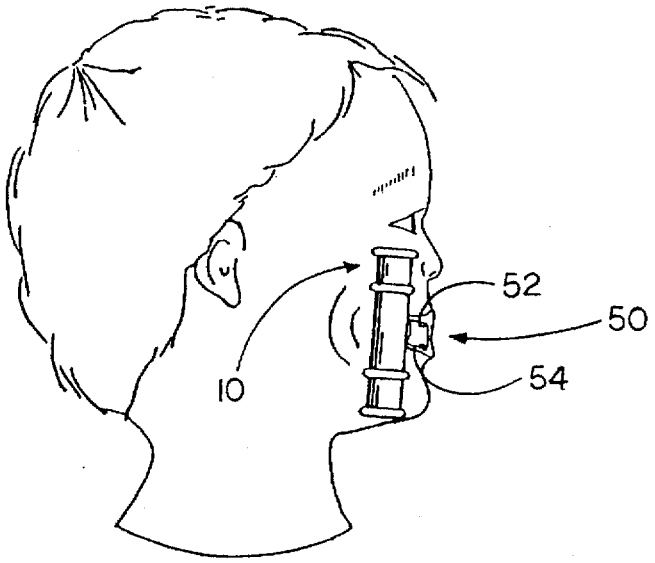

The next step would be to insert the biting portion 12 of one of the chewing devices 10 between the biting surfaces of the orally dysfunctional person's mouth. Most optimally, the chewing device 10 would be located in the manner shown in FIGS. 5A and 5B wherein the rod's biting portion 12 is located between a upper biting surface 52 and a lower biting surface 54 of a person's mouth 50. Since by the very nature of this invention the persons on which the device 10 shall be used are orally dysfunctional, the therapist's manual and instructional assistance may be necessary for generating oral acceptance of the device 10. For example, this may be necessary with children who exhibit a tonic bite reflex wherein the jaw quickly closes and becomes statically clenched in response to an outside stimulus such as a spoon, a finger, or possibly the device 10. Eliminating the limiting effects of such reflexes by methods known in the art is important to achieving the invention's goals of developing a controlled and sustainable cyclic biting ability.

With the elongated tubular biting portion 12 properly in place, the person then is instructed and, if necessary, assisted by the therapist to engage in a graded jaw closure of the upper and lower biting surfaces 52 and 54 about the biting portion 12. Next, the person is instructed and, if necessary, assisted to engage in and sustain a graded closure about the biting portion 12 of the device 10 for increasing lengths of time ranging from about two to five seconds at the outset to periods of more than about ten seconds as ability and endurance increase. To further improve jaw strength and pressure, the therapist again may encourage and, if necessary, assist in holding the device 10 between the upper and lower biting surfaces 52 and 54 of the mouth 50 while now tugging lightly on the crossbar 24 which comprises the handle portion of the device 10.

Having established the ability to engage the biting surfaces 52 and 54 in a sustained jaw closure about the biting portion 12, the person then is instructed and, if necessary, assisted in demonstrating jaw excursion followed by closure on the elongated tubular biting portion 12 of the device 10 for at least one cycle. With this potentially novel oral motor function achieved, the person is encouraged and, if necessary, assisted to increase gradually the number of cycles of excursion and closure about the biting portion 12 with the ultimate goal being over about twenty rhythmical cycles in a single set.

There being developed with a relatively thick chewing device the ability to engage in a cycle of mandibular excursion and closure in a person who was not able to do so previously, the next sequence of steps in the most preferred method of practicing the invention would repeat the above-described steps except with a device 10 having a different lateral thickness at its biting portion. In this practicing of the invention, where the situation required starting with a relatively thick chewing device 10, as with a child exhibiting jaw thrust, the steps are repeated with a slightly thinner device such as the device 10 shown in FIG. 3C. Once properly carried out with that device 10, the steps are repeated with increasingly thinner devices such as those shown in FIGS. 3B and 3A until the desired volitional cyclic oral motor function is achieved. As the subject progressively develops oral motor function with the non-nutritive chewing devices 10, steps may be taken to ease the transition to nutritive chewing. For example, it has been found to be advantageous to dip the biting portion 12 of the device 10 in a nutritive substance to facilitate the transition.

It is contemplated that the order of varying lateral thicknesses can be varied to suit the needs and abilities of the person exhibiting the oral motor dysfunction. The above-described sequence of progressively varying the useful lateral thickness of the chewing devices 10 from relatively thick to relatively thin is merely one example of applying the inventive method. Provided that the mandible is capable of demonstrating sufficient excursion to accept a relatively thick device 10, such a sequence has been found useful in cases in which the oral motor dysfunction to be addressed hinders adequately graded, cyclic excursion and closure of the mandible.

For example, such a progression has been found generally appropriate with children having developmental neuromuscular disorders such as cerebral palsies of the ataxic, spastic, or athetoid type and with children exhibiting muscle tonus disorders generally associated with Down's Syndrome. In each of these situations, persons tend to demonstrate primitive or abnormal oral patterns such as jaw thrust, jaw clenching, jaw retraction, jaw instability, tonic bite reflex, lip and tongue retraction, low muscular tone, and tongue thrust.

In addition, a thick-to-thin progression has been found appropriate in cases in which an inability to demonstrate sustained and controlled jaw closure is secondary to neurological insult such as head trauma. Still further, a thick-to-thin progression has been found appropriate when the subject has never learned or does not remember what it feels like to close his or her jaw in a proper, rhythmical manner. Frequently, this may be seen with individuals having sensory-based disorders with difficulties in integrating tactile and proprioceptive input. Without adequate integration of sensory information, these persons often are unable to engage in sustained, controlled and repetitive jaw movement which is necessary for safe and proper mastication.

This circular phenomenon has until now deprived such individuals of the ability to carry out safe and efficient mastication. Advantageously, use of a device 10 with a relatively thick biting portion 12 supplies the missing proprioceptive input to this type of orally dysfunctional person. It does so by occupying the open area in the person's mouth to produce an artificial feeling of contact between the upper and lower biting surfaces 52 and 54. This artificial contact provides a sense of closure which allows the jaw to learn to build up the crushing and grinding pressure necessary to chew food. By progressing to devices 10 having thinner biting portions 12, functional jaw closure in the chewing sense is approximated. The final result is the ability to engage in a controlled and sustained closure of the mandible without a chewing device 10 in place.

However, oral motor dysfunction also manifests itself in situations which require beginning with a relatively thin chewing device 10 to be followed by progressively thicker devices 10. For example, such a procession is compelled when the oral dysfunction limits the range of motion of the mandibular joint. This often is the case with a person who's oral motor dysfunction has been effected by traumatic brain injury or stroke. Each such event can inflict a cerebral lesion which may lead to a degeneration in the range of mandibular motion necessary for safe and effective biting and chewing. Such a primitive and limited range of jaw motion forces beginning with a chewing device 10 having a relatively thin biting portion 12 as that would be the only size which would fit between the person's biting surfaces. As volitional excursion and closure of the mouth is achieved with the relatively thin initial device 10, the steps would be repeated with progressively thicker devices 10 until the previously clenched mandibular joint enjoys a sufficiently broad range of motion to allow for proper mastication.

Regardless of the sequence of the progressive method, significant benefits are achieved by crafting the device's biting portion of a non-toxic and non-nutritive material which not only allows lateral compression of the biting portion when pressed on by the subject's biting surfaces but which also tends to exert a resilient biasing toward the biting portion's non-compressed condition. Resiliently yieldable plastic tubing has been found to provide these qualities most satisfactorily, and clear vinyl plastic tubing and polyvinyl plastic tubing have proven themselves particularly suitable.

In practice, the resiliency of properly selected tubing sponsors what may be termed a rebound effect which facilitates the rhythmical and cyclic jaw motion which is necessary to chewing. Under this rebound effect, the resilient biasing of the tube encourages a nearly automatic excursion of the mandibular joint upon the lessening of jaw pressure on the tube. This assisted excursion pushes the biting surfaces into position for a succeeding jaw closure. In practice, the resilient tubing will encourage a cycle of making contact with the tube, increasing pressure on the tube to compress it, and opening the mouth under the tube's rebound effect. By developing the ability to engage in multiple cycles of controlled excursion and closure of the jaw, the inventive method and device teach the previously orally dysfunctional person to chew.

From the foregoing, it is apparent that the present invention offers tremendous benefits to those suffering from oral motor dysfunction including those affected by neurological impairments due to stroke and head trauma, those affected by developmental conditions leading to affectations such as tonic bite reflex or jaw thrust, and those affected by structural abnormalities due to injury, disease or congenital sources. In sum, the invention's chewing devices, when used according to the invention's multi-step, progressive process, enable safe eating through the mouth by those who otherwise would be unable to do so effectively. As a result, those employing the invention can maximize their potential with respect to mastication whereby he or she may minimize or avoid the need for medical intervention or dietary manipulation. These benefits are achieved in part by employing the invention's chewing devices to develop graded jaw closure and repetitive, rhythmical mandibular movement over an improved range of motion. The benefits are supplemented by the invention's resultant improvement in jaw, tongue, lip and cheek dexterity and independence of movement. Consequently, eating can become a safer and more independent activity for the previously orally dysfunctional, and both the care giver and the user are saved from the cumbersome, frustrating, and possibly dangerous results of the inability to practice proper biting and chewing.

Although the inventive method and device have been shown and described with reference to certain preferred examples, those skilled in the art can conceive of alternative embodiments. Accordingly, the following claims are intended to define the scope of protection to be afforded the inventor, and the claims shall be deemed to include equivalent constructions insofar as they do not depart from the spirit and scope of the present invention.

I claim as deserving the protection of United States Letters Patent:

1. A method for improving the oral motor function of persons with oral motor dysfunction, the method comprising the steps of:

a) providing at least one chewing device comprising a non-nutritive, non-toxic and elongated biting portion which has a given effective lateral thickness and is adapted to be received between an upper and a lower biting surface of an orally dysfunctional person's mouth and a handle portion securely connected to the biting portion for enabling manipulation of the device from a position external to a user's mouth;

b) inserting the biting portion of the chewing device between the biting surfaces of the orally dysfunctional person's mouth; instructing and, if necessary, assisting the orally dysfunctional person to hold the chewing device by its biting portion in a selected position between the biting surfaces of the person's mouth for a given length of time; then instructing and, if necessary, assisting the orally dysfunctional person to hold the chewing device by its biting portion in the selected position between the biting surfaces of the person's mouth for progressively greater lengths of time; and c) instructing and, if necessary, assisting the orally dysfunctional person to engage in at least one cycle of excursion and closure of the biting surfaces of the person's mouth on the biting portion of the chewing device with the chewing device in the selected position; then instructing and, if necessary, assisting the orally dysfunctional person to engage in a progressively increasing number of cycles of repetitive excursion and closure on the biting portion of the device; and d) repeating at least steps a) and c) with additional chewing devices wherein at least one of the additional chewing devices has a biting portion with a different effective lateral thickness from the effective lateral thickness of the at least one chewing device.

2. The method of claim 1 wherein the step of providing at least one chewing device comprises the providing of a chewing device with at least the biting portion thereof comprised of a yieldable and resilient tube with a uniform lateral thickness therealong.

3. The method of claim 2 wherein each of the steps of inserting the chewing device between the biting surfaces of an orally dysfunctional person's mouth comprises inserting the chewing portion of the device in a lateral position in an orally dysfunctional person's mouth.

4. The method of claim 1 wherein the step of repeating at least steps a) and c) is carried out with a multiplicity of additional chewing device with biting portions with progressively thinner effective lateral thicknesses.

5. The method of claim 1 wherein the step of repeating at least steps a) and c) is carried out with a multiplicity of additional chewing device with biting portions with progressively thicker effective lateral thicknesses.

* * * * *